US008328039B2

(12) United States Patent
Short et al.

(10) Patent No.: US 8,328,039 B2
(45) Date of Patent: Dec. 11, 2012

(54) NESTABLE PRODUCE CONTAINER

(75) Inventors: Philip Raymond Short, Vineland Station (CA); Xie Fu Song, Shantou (CN)

(73) Assignee: Vortex Packaging Niagara, Inc. (CA)

( * ) Notice: Subject to any disclaimer, the term of this patent is extended or adjusted under 35 U.S.C. 154(b) by 1051 days.

(21) Appl. No.: 12/323,190

(22) Filed: Nov. 25, 2008

(65) Prior Publication Data

US 2010/0127010 A1 May 27, 2010

(51) Int. Cl.
*B65D 45/16* (2006.01)
*B65D 43/03* (2006.01)

(52) U.S. Cl. ..... 220/324; 220/781; 206/515

(58) Field of Classification Search ..... 220/324, 220/825, 835, 263, 266, 781, 787, 819; 229/123.2, 229/123.3, 125.14, 125.15; 206/497, 515, 206/533, 534, 538, 583, 783
See application file for complete search history.

(56) References Cited

U.S. PATENT DOCUMENTS

| | | | | | |
|---|---|---|---|---|---|
| 2,839,214 | A * | 6/1958 | Crane | 220/4.28 |
| 3,351,227 | A * | 11/1967 | Collie | 220/788 |
| 3,477,609 | A * | 11/1969 | Winkler, Jr. | 220/784 |
| 3,716,164 | A * | 2/1973 | Fennema | 220/786 |
| 3,795,360 | A * | 3/1974 | Bianchi et al. | 220/786 |
| 3,836,040 | A * | 9/1974 | Paine et al. | 220/786 |
| 3,837,526 | A * | 9/1974 | Medendorp | 220/782 |
| 3,900,129 | A * | 8/1975 | Scholz | 220/784 |
| 5,465,901 | A * | 11/1995 | Paine, Jr. | 229/407 |
| 5,820,908 | A * | 10/1998 | Li | 426/396 |
| D425,704 | S * | 5/2000 | Zamecnik | D3/309 |
| D450,925 | S * | 11/2001 | Zamecnik | D3/302 |
| 6,918,508 | B2 * | 7/2005 | Hwang | 220/826 |
| D573,015 | S * | 7/2008 | Chen | D9/427 |
| 7,621,417 | B2 * | 11/2009 | Peterson et al. | 220/254.3 |
| 2004/0026438 | A1 * | 2/2004 | Tyra et al. | 220/660 |
| 2004/0094319 | A1 * | 5/2004 | Koessler | 174/50 |
| 2009/0242631 | A1 * | 10/2009 | Wishnatzki et al. | 235/385 |

* cited by examiner

*Primary Examiner* — Mickey Yu
*Assistant Examiner* — Ernesto Grano
(74) *Attorney, Agent, or Firm* — Steven M. Greenberg; Carey, Rodriguez, Greenberg & O'Keefe, LLP

(57) ABSTRACT

A produce container comprises a basket portion and a closure portion, which are hingedly secured to one another to be relatively movable between an open configuration and a closed configuration. The container can be secured in the closed configuration by way of at least one tab projecting upwardly from a front edge of a basket portion peripheral lip, which is received within a corresponding slot defined inwardly of the front edge of a closure portion peripheral lip. Each slot extends into a collocated recess in the outer surface of the closure portion peripheral lip, and each tab has an outwardly extending locking projection which, in the closed configuration, engages a corresponding recess engagement surface. Each locking projection terminates inwardly of the outer surface of the front edge of the closure portion peripheral lip and each tab terminates below the upper surface of the closure portion peripheral lip.

5 Claims, 11 Drawing Sheets

NESTABLE PRODUCE CONTAINER

FIELD OF INVENTION

The present invention relates to containers, and more particularly to containers for produce.

BACKGROUND OF THE INVENTION

Fresh produce, including fruits such as strawberries, is often packed into individual containers, for sale in a retail marketplace. For example, strawberries may be packed into one quart containers for sale. An example of such a prior art container is indicated generally by the reference numeral 1 in FIG. 11. Such containers have typically comprised a basket portion 2 hingedly coupled to a closure portion 3, which have been lockable by securing locking tabs 4, which project downwardly from a first peripheral lip 5 on the closure portion 3, within locking brackets 6 located on the outside of a second peripheral lip 7 on the basket portion 2. A lid 8, typically made from clear plastic, may be secured to a terminal rim 9 on the closure portion 3.

SUMMARY OF THE INVENTION

In one aspect, the present invention is directed to a produce container. The produce container comprises a basket portion, the basket portion comprising a base and four basket portion walls extending between the base and a basket portion peripheral lip. Each basket portion wall is secured to each adjacent basket portion wall. The produce container further comprises a closure portion, the closure portion comprising a terminal rim and four closure portion walls extending between the terminal rim and a closure portion peripheral lip. Each closure portion wall is secured to each adjacent closure portion wall. The basket portion peripheral lip and the closure portion peripheral lip are hingedly secured to one another at respective rear edges thereof so that the basket portion and the closure portion are relatively movable between an open configuration and a closed configuration in which the basket portion peripheral lip and the closure portion peripheral lip are in registration with one another. The basket portion peripheral lip has at least one tab projecting upwardly from a front edge thereof, with each at least one tab including an outwardly extending locking projection. The front edge of the closure portion peripheral lip includes at least one receiving slot defined inwardly of the outer surface of the front edge of the closure portion peripheral lip for receiving a corresponding tab. Each such receiving slot extends into a collocated recess defined in the outer surface of the front edge of the closure portion peripheral lip, each such recess having a recess engagement surface. When the basket portion and the closure portion are in the closed configuration, the at least one tab is received within the at least one corresponding receiving slot so that each respective locking projection extends into the respective recess and an engagement surface on the respective locking projection cooperates with the respective recess engagement surface to secure the container in the closed configuration. Each respective locking projection terminates inwardly of the outer surface of the front edge of the closure portion peripheral lip, and each tab terminates below the upper surface of the closure portion peripheral lip.

In an embodiment, each at least one tab projects upwardly from a position spaced inwardly from the outer surface of the basket portion peripheral lip, and each locking projection terminates inwardly of the outer surface of the basket portion peripheral lip. In a particular embodiment, the receiving slots are defined in a lower surface of the front edge of the closure portion peripheral lip and extend through the closure portion peripheral lip into their respective recesses. In a yet more particular embodiment, the closure portion peripheral lip includes backing regions of increased thickness projecting inwardly, and the backing regions are collocated with the receiving slots and comprise part of the inner surface of the front edge of the closure portion peripheral lip.

In an embodiment, the at least one tab comprises two tabs spaced from one another and the at least one receiving slot comprises two receiving slots spaced from one another. In a particular embodiment, each tab has a height of approximately 5 millimeters, measured from an upper surface of the basket portion peripheral lip, the front edge of the closure portion peripheral lip has a height of approximately 7 millimeters, measured from the lower surface of the closure portion peripheral lip to the upper surface of the closure portion peripheral lip, and the recesses extend downwardly from the upper surface of the closure portion peripheral lip by approximately 4.5 millimeters.

In an embodiment, the basket portion walls each comprise a plurality of individual substantially parallel basket portion wall members extending between the base and the basket portion peripheral lip, and the closure portion walls each comprise a plurality of individual substantially parallel closure portion wall members extending between the terminal rim and the closure portion peripheral lip.

In an embodiment, the basket portion and the closure portion collectively define approximately a one-quart volume.

In one embodiment, the produce container further comprises a lid removably secured to the terminal rim. In a particular embodiment, the lid comprises a substantially square, substantially planar covering portion having four edges, with four spacing walls depending downwardly from the edges of the covering portion, with each spacing wall continuing into an outwardly extending upper support surface which is substantially parallel to the covering portion so that there are four upper support surfaces. The four upper support surfaces are, collectively, co-extensive with the upper surface of the terminal rim of the produce container, and each upper support surface has defined therein a plurality of downwardly extending upper engagement fingers. Each upper support surface continues into a substantially downwardly extending side wall so that there are four such side walls, with the side walls terminating in a generally outwardly extending peripheral skirt, and each side wall has a plurality of inwardly extending side wall engagement fingers. The upper engagement fingers are vertically spaced from the side wall engagement fingers by a distance corresponding to the vertical height of the terminal rim, and the lid is removably secured to the container by an interference fit of the terminal rim between the upper engagement fingers and the side wall engagement fingers. In a specific embodiment, the upper engagement fingers and the side wall engagement fingers are in an offset, opposed relationship so that each upper engagement finger is vertically spaced above, and horizontally positioned between, two side wall engagement fingers, and each side wall engagement finger is vertically spaced below, and horizontally positioned between, two upper engagement fingers. In a still more specific embodiment, two spaced-apart upper engagement fingers are disposed on each upper support surface, and one upper engagement finger is positioned at each corner junction joining adjacent upper support surfaces, and each side wall has three inwardly extending side wall engagement fingers, one side wall engagement finger being positioned approximately at a midpoint of the respective side wall, and one side wall engagement finger being positioned at each end of the respective side wall.

In an embodiment, each of the side wall engagement fingers has a generally triangular shape, including a downwardly sloping upper surface and an upwardly sloping lower surface.

In an embodiment, the covering portion has a plurality of apertures defined therein adjacent the edges of the covering portion. The apertures are positioned so as to define a corner region of the covering portion that is free of apertures, and the lid includes a generally triangular adhesive label applied to the corner region.

In particular embodiment, a quantity of produce, including but not limited to strawberries, is disposed within the produce container.

In another aspect, the present invention is directed to a lid for a produce container, as described above.

BRIEF DESCRIPTION OF THE DRAWINGS

These and other features of the invention will become more apparent from the following description in which reference is made to the appended drawings wherein.

DETAILED DESCRIPTION

Figure 11:
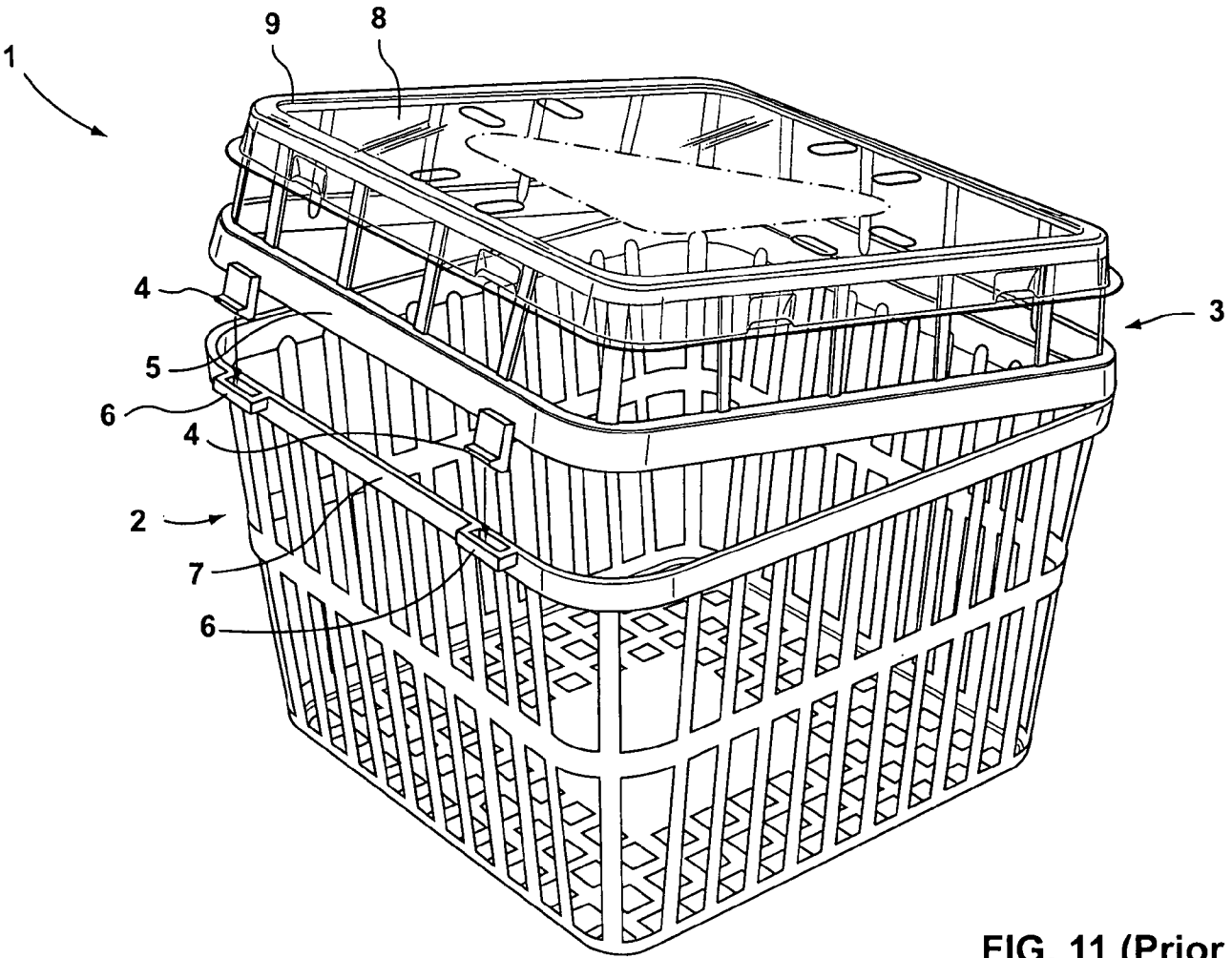
FIG. 11 (Prior Art)
FIG. 11 is a perspective view of a prior art produce container.

Prior art produce containers, such as the prior art produce container 1 described in the context of FIG. 11, are generally shipped in an open configuration, nested together in a stack, with each closure portion 3 nested inside the closure portion 3 of the container below it in the stack, and each basket portion 2 similarly nested inside the basket portion 2 of the container below. However, the locking brackets 6 located on the outside of the second peripheral lip 7 on the basket portion 2 interfere with the fit of the nested container stacks inside the standard boxes in which they are shipped, since these boxes are designed to accommodate the shape of the first and second peripheral lips 5, 7, and generally do not accommodate the locking brackets 6 protruding outwardly from the second peripheral lip 7.

Before turning to FIGS. 1 to 10B, it should be noted that, in order to facilitate readability of the Figures, not all elements of the illustrated embodiment are labeled in all Figures, and elements have generally been labeled in those Figures in which they are best visible.

Figure 1:
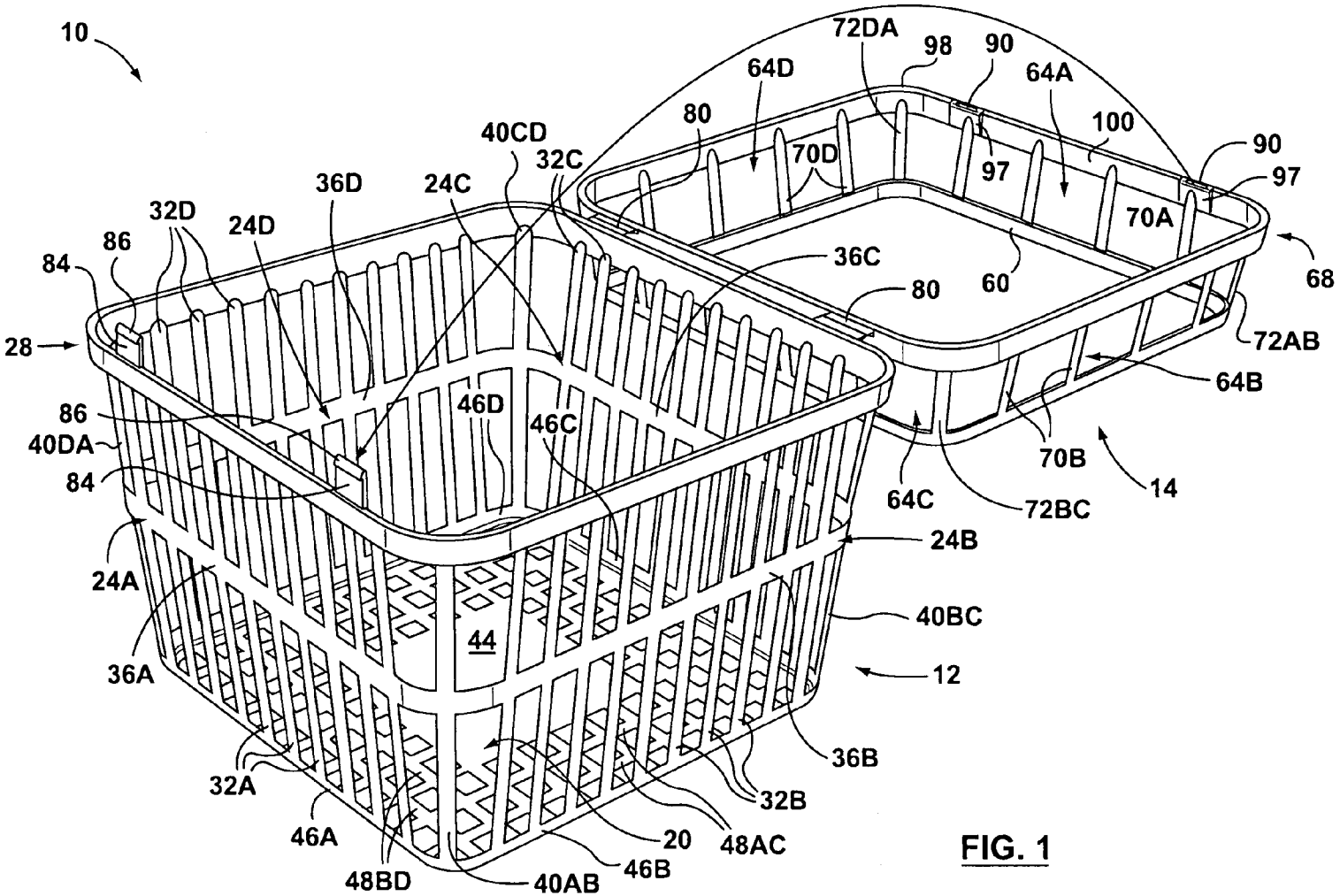
FIG. 1 is a perspective view of an exemplary produce container according to an aspect of the present invention, shown in an open configuration.
Figure 2:
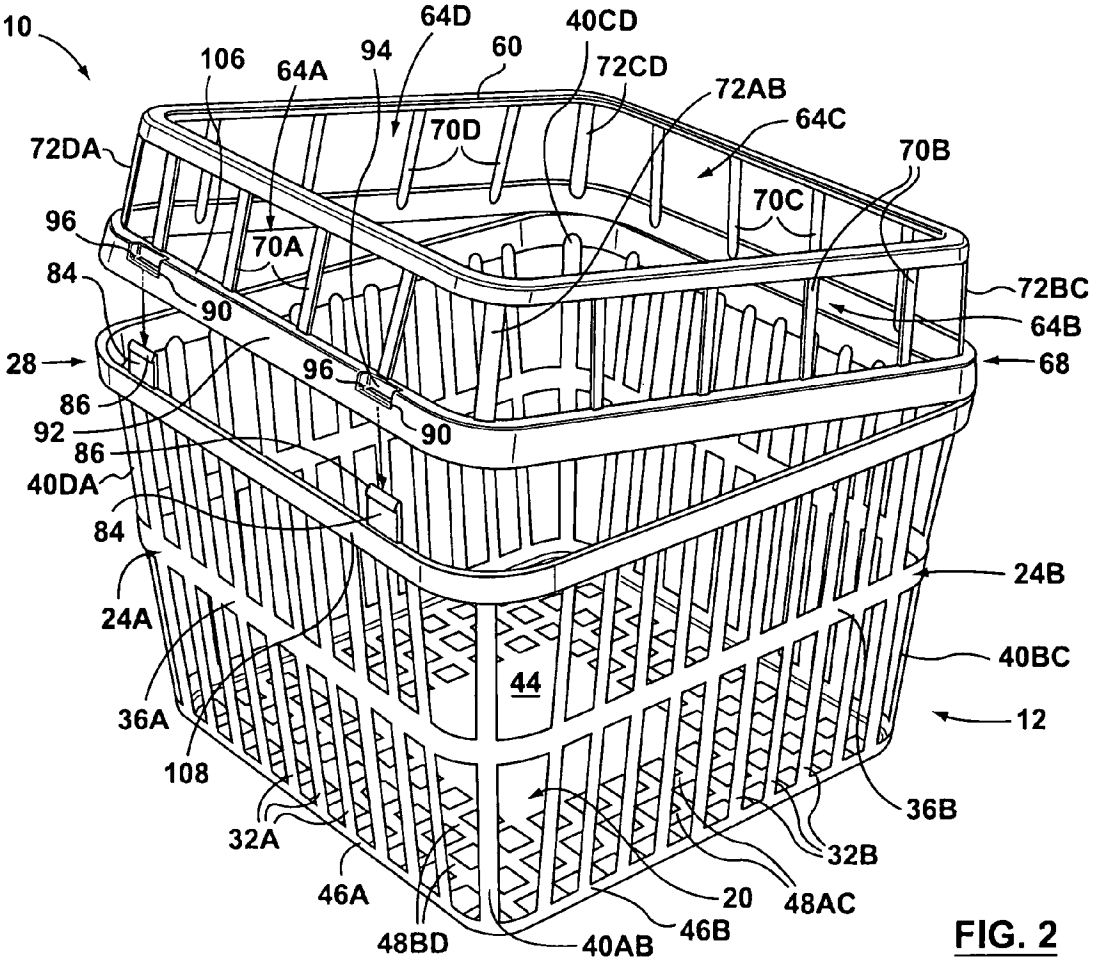
FIG. 2 is a perspective view of the exemplary produce container of FIG. 1, shown in transition between the open configuration in FIG. 1 and a closed configuration as shown in FIG. 3.
Figure 3:
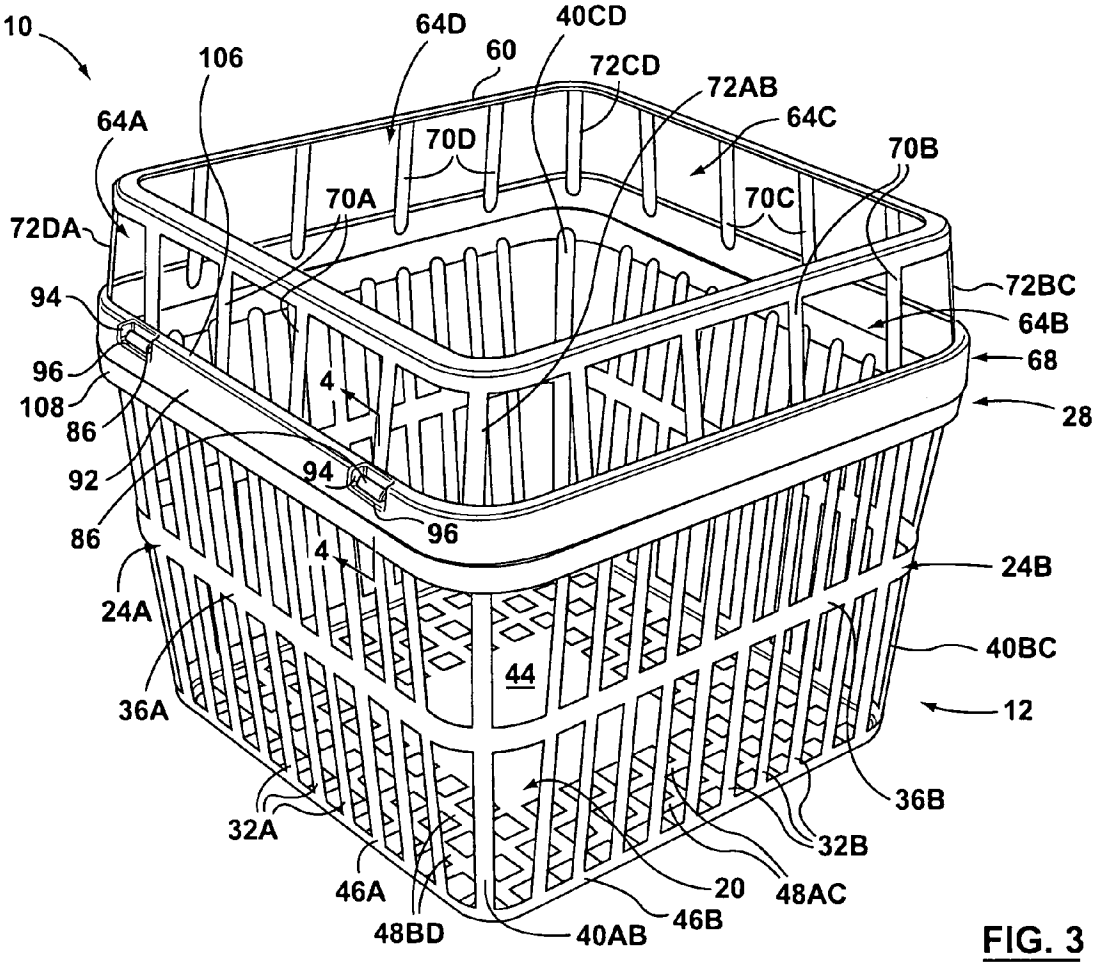
FIG. 3 is a perspective view of the exemplary produce container of FIG. 1, shown in the closed configuration.

With reference now to FIGS. 1 to 3, an exemplary produce container according to an aspect of the present invention is shown generally at 10. The produce container 10 comprises a basket portion 12 and a closure portion 14. The produce container 10 may be made from a flexible, resilient material, such as a suitable combination of polypropylene (PP) and polyethylene (PE) plastics, and in one embodiment is made from a material comprising approximately 85% polypropylene and approximately 15% polyethylene is used. In the exemplary embodiment, the basket portion 12 and the closure portion 14 collectively define approximately a one-quart volume.

The basket portion 12 comprises a base 20, and four basket portion walls, indicated generally by the reference numerals 24A, 24B, 24C and 24D, extending between the base 20 and a basket portion peripheral lip 28. As can be seen, in the exemplary embodiment illustrated, the basket portion walls 24A, 24B, 24C and 24D each comprise a plurality of respective individual substantially parallel basket portion wall members 32A, 32B, 32C and 32D extending between the base 20 and the basket portion peripheral lip 28. Each of the individual substantially parallel basket portion wall members 32A, 32B, 32C and 32D is secured to each adjacent substantially parallel basket portion wall member 32A, 32B, 32C and 32D by way of a respective lateral reinforcing member 36A, 36B, 36C and 36D extending along the width of the respective basket portion wall 24A, 24B, 24C and 24D substantially perpendicularly to the basket portion wall members 32A, 32B, 32C and 32D. It will be appreciated that where a container 10 according to an aspect of the present invention is integrally formed, the lateral reinforcing members 36A, 36B, 36C and 36D may comprise a plurality of individual webs interconnecting each adjacent basket portion wall member 32A, 32B, 32C and 32D, which, taken together along with the relevant portions of the basket portion wall members 32A, 32B, 32C and 32D, form the respective lateral reinforcing members 36A, 36B, 36C and 36D. In other words, the lateral reinforcing members 36A, 36B, 36C and 36D may be comprised of material also comprising part of the respective basket portion wall members 32A, 32B, 32C and 32D. Additionally, it will be seen that each basket portion wall 24A, 24B, 24C, 24D is secured to each adjacent basket portion wall 24A, 24B, 24C, 24D. In particular, corner members 40AB, 40BC, 40CD and 40DA extending between the base 20 and the basket portion peripheral lip 28 define the junctions, respectively, between adjacent basket portion walls 24A and 24B, 24B and 24C, 24C and 24D, and 24D and 24A, and the lateral reinforcing members 36A, 36B, 36C and 36D continue into the respective corner members 40AB, 40BC, 40CD and 40DA.

In the exemplary embodiment 10 illustrated herein, the base 10 comprises a substantially square central portion 44, four base edge portions 46A, 46B, 46C and 46D, and two sets of substantially parallel base cross-members 48AC and 48BD, with the first set of base cross-members 48AC being substantially perpendicular to the second set of base cross-members 48BD. The first set of base cross-members 48AC extends between the base edge portions 46A and 46C, and between the base edge portion 46A and the central portion 44 and between the base edge portion 46C and the central portion 44. Similarly, the second set of base cross-members 48BD extends between the base edge portions 46B and 46D, and between the base edge portion 46B and the central portion 44 and between the base edge portion 46D and the central portion 44. As can be seen, the sets of base cross-members 48AC and 48BD are interconnected with one another in a grid pattern. As can also be seen, the basket portion wall members 32A, 32B, 32C, 32D extend from respective base edge portions 46A, 46B, 46C and 46D.

Continuing to refer to FIGS. 1 to 3, the closure portion 14 comprises a terminal rim 60 and four closure portion walls 64A, 64B, 64C and 64D extending between the terminal rim and a closure portion peripheral lip 68. The closure portion walls 64A, 64B, 64C and 64D each comprise a plurality of respective individual substantially parallel closure portion wall members 70A, 70B, 70C and 70D extending between the terminal rim 60 and the closure portion peripheral lip 68. Each closure portion wall 64A, 64B, 64C, 64D is secured to each adjacent closure portion wall 64A, 64B, 64C, 64D. In particular, corner members 72AB, 72BC, 72CD and 72DA extending between the terminal rim 60 and the closure portion peripheral lip 68 define the junctions, respectively, between adjacent closure portion walls 64A and 64B, 64B and 64C, 64C and 64D, and 64D and 64A.

It will be appreciated that in the above-described exemplary construction, the basket portion walls 24A, 24B, 24C and 24D and the closure portion walls 64A, 64B, 64C and 64D are not solid walls, but rather are mesh-type walls, with openings or spaces being defined between the adjacent basket portion wall members 32A, 32B, 32C, 32D and the adjacent closure portion wall members 70A, 70B, 70C, 70D. The openings or spaces permit the produce to "breathe", and of course should be sufficiently small to permit the container 10 to retain therewithin the produce it is being used to package. It will also be appreciated that the basket portion walls 24A, 24B, 24C and 24D and the closure portion walls 64A, 64B, 64C and 64D may be constructed in many other ways, without departing from the scope of the present invention.

Continuing to refer to FIGS. 1 to 3, the basket portion 12 and the closure portion 14 are hingedly secured to one another. More particularly, in the exemplary produce container 10, the basket portion peripheral lip 28 and the closure portion peripheral lip 68 are hingedly secured to one another at respective rear edges thereof. In this embodiment, the rear edge of the basket portion peripheral lip 28 is the portion thereof corresponding to the rear basket portion wall 24C, and the rear edge of the closure portion peripheral lip 68 is the portion thereof corresponding to the rear closure portion wall 64C, and in the illustrated embodiment these are hingedly secured to one another by way of two spaced-apart living hinges 80. The hinged connection between the basket portion peripheral lip 28 and the closure portion peripheral lip 68 enables the basket portion 12 and the closure portion 14 to be moved, relative to one another, between an open configuration, as shown in FIG. 1, and a closed configuration in which the basket portion peripheral lip 28 and the closure portion peripheral lip 68 are in registration with one another, as shown in FIG. 3.

Referring now in particular to FIG. 2, the basket portion peripheral lip 28 has two spaced-apart tabs 84 projecting upwardly from a front edge thereof, with each tab 84 including an outwardly extending locking projection 86. The front edge of the basket portion peripheral lip 28 is the portion thereof corresponding to the front basket portion wall 24A. While the illustrated embodiment shows the use of two tabs 84, one skilled in the art will appreciate, once informed by the herein disclosure, that a single, centrally positioned tab, or more than two tabs, may be used without departing from the scope of the present invention.

Continuing to refer to FIG. 2, the front edge of the closure portion peripheral lip 68 (that is, the portion thereof corresponding to the front closure portion wall 64A) includes two spaced-apart receiving slots 90 (see FIG. 1) defined inwardly of an outer surface 92 of the front edge of the closure portion peripheral lip 68. The receiving slots 90 are located at positions on the front edge of the closure portion peripheral lip 68 corresponding to the positions of the tabs 84 on the front edge of the basket portion peripheral lip 28, and are sized and shaped to receive a corresponding tab 84. Each receiving slot 90 extends into a collocated recess 94 defined in the outer surface 92 of the front edge of the closure portion peripheral lip 68, and each recess 94 has a recess engagement surface 96. In the illustrated embodiment, the receiving slots 90 are defined in a lower surface 98 of the front edge of the closure portion peripheral lip 68 and extend upwardly through the closure portion peripheral lip 68 into their respective recesses 94. As can best be seen in FIG. 1, the closure portion peripheral lip 68 includes backing regions 97 which are collocated with the receiving slots 90, and form part of an inner surface 100 of the front edge of the closure portion peripheral lip 68. The backing regions 97 are regions of increased thickness projecting inwardly, which provide structural reinforcement for the receiving slots 90.

Figure 4:
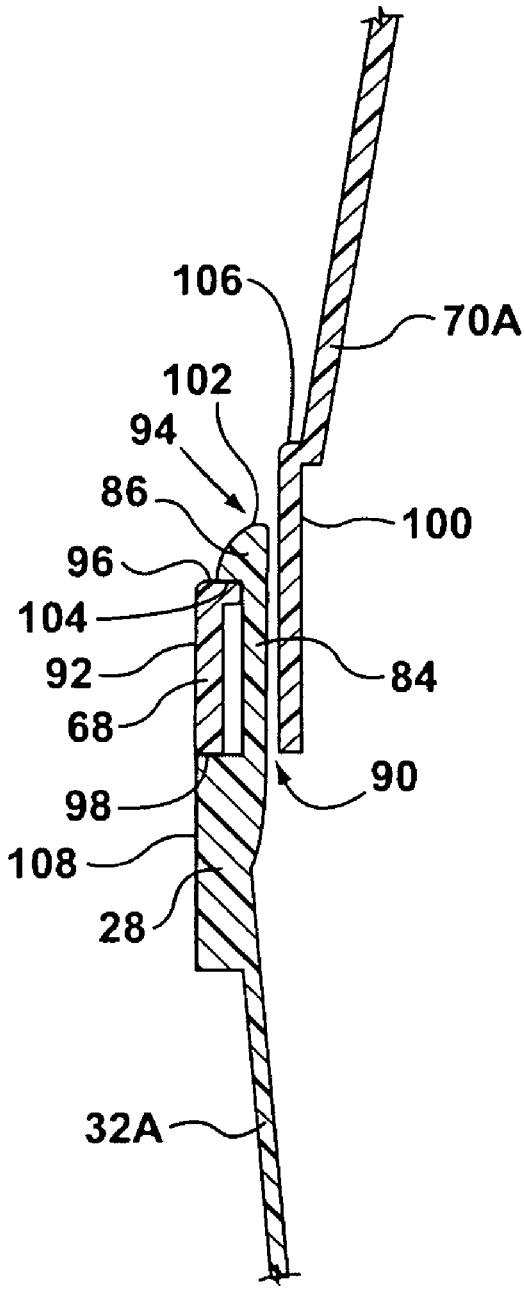
FIG. 4 is a cross sectional view taken along the line 4-4 in FIG. 3.

Referring now to FIG. 4, engagement of the tabs 84 with the receiving slots 90 and collocated recesses 94 when the basket portion 12 and the closure portion 14 are in the closed configuration is illustrated in greater detail. Each of the tabs 84 is received within a corresponding receiving slot 90 so that the locking projection 86 on that tab 84 extends into the respective recess 94. Each locking projection 86 has a rounded upper surface 102 which facilitates insertion into and passage through the receiving slot 90 into the recess 94. Each locking projection 86 also has an engagement surface 104 on its underside, which cooperates with the respective recess engagement surface 96 to secure the container 10 in the closed configuration. As can be seen, in the illustrated embodiment, when the produce container 10 is in the closed configuration, each locking projection 86 terminates inwardly of (i.e. does not extend beyond) the outer surface 92 of the front edge of the closure portion peripheral lip, and each tab 84, including the locking projection thereof, terminates below (i.e. does not extend beyond) the upper surface 106 of the closure portion peripheral lip 68. Moreover, in the illustrated embodiment each tab 84 projects upwardly from a position spaced inwardly from the outer surface 108 of the front edge of the basket portion peripheral lip 28, and each locking projection 86 terminates inwardly of (i.e. does not extend beyond) the outer surface 108 of the basket portion peripheral lip 28.

Figure 5:
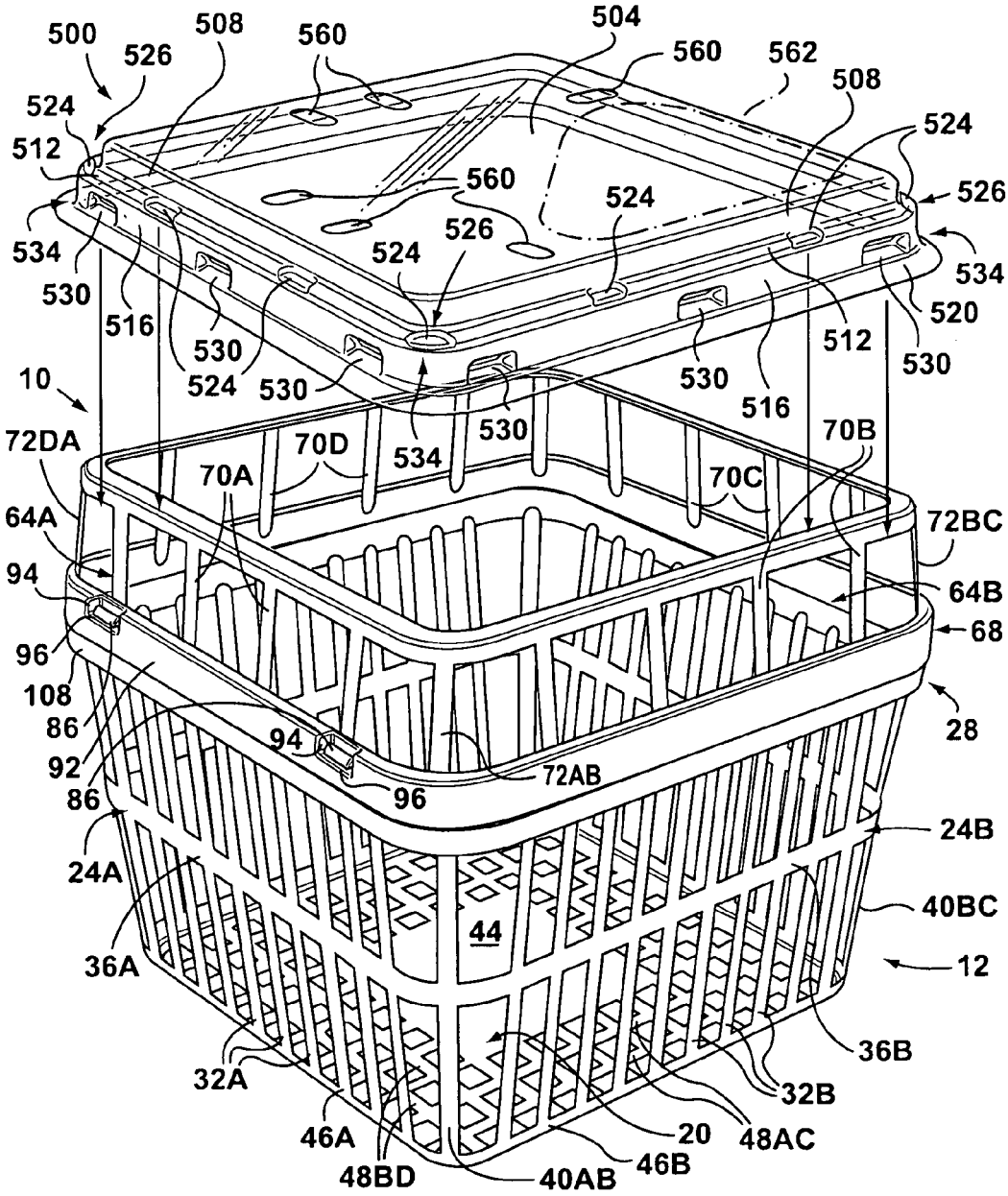
FIG. 5 is a perspective view of the exemplary produce container of FIG. 1, showing an exemplary lid according to an aspect of the present invention positioned for installation on the exemplary produce container of FIG. 1.
Figure 6:
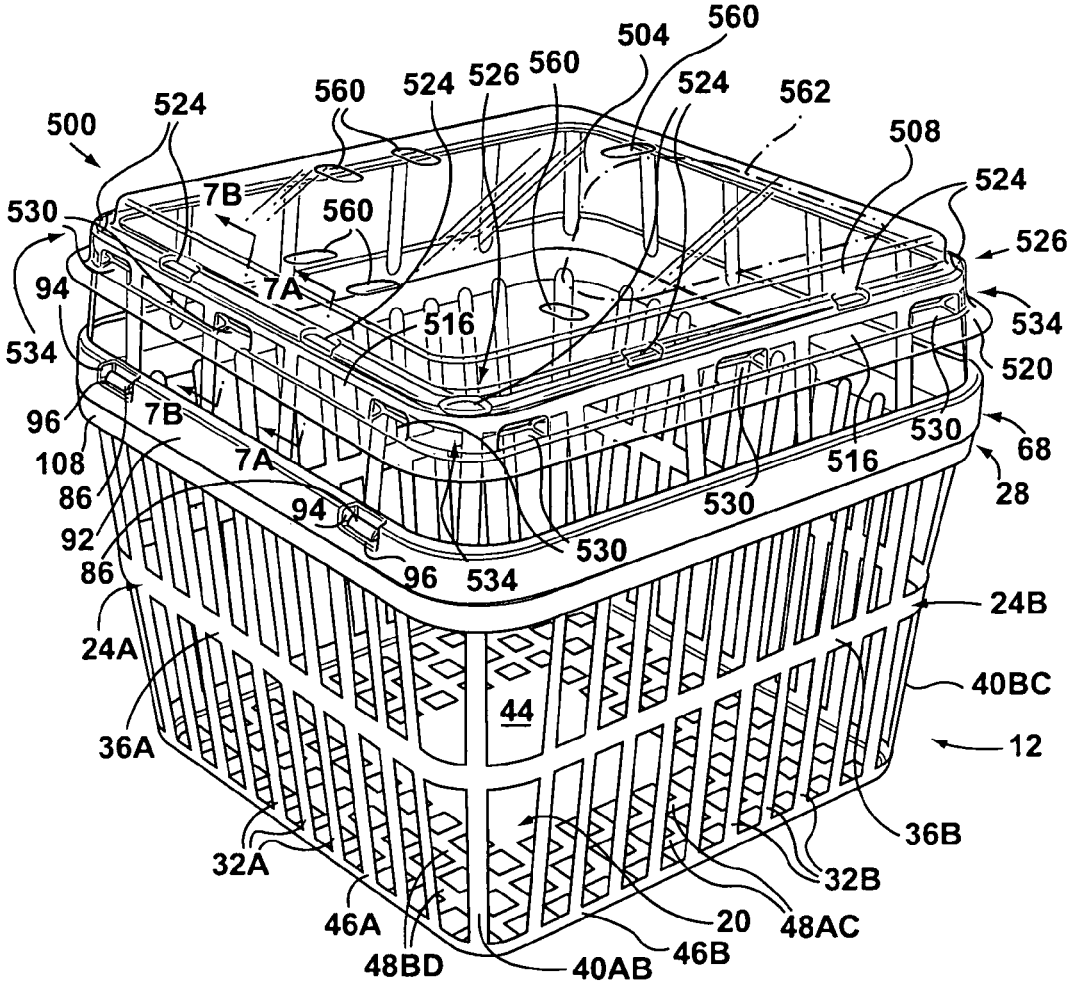
FIG. 6 is a perspective view of the exemplary produce container of FIG. 1, with the exemplary lid of FIG. 5 secured thereon.

Reference is made now to FIGS. 5 and 6, showing a lid 500 which may be removably secured to the terminal rim 60 of the exemplary container 10, which lid 500 is sized and shaped for such purpose. The lid 500 may be made from a flexible, resilient material, such as clear polyethylene terephthalate (PET) plastic.

In the illustrated embodiment, the lid 500 comprises a substantially square (although the corners are rounded), substantially planar covering portion 504 having four spacing walls 508 depending downwardly from the edges of the covering portion 504. Each of the spacing walls 508 continues into an outwardly extending upper support surface 512 which is substantially parallel to the covering portion 504. The four upper support surfaces 512 are, collectively, co-extensive with, and therefore adapted to be supported by, the terminal rim 60 of the produce container 10. The upper support surface 512 continues into four substantially downwardly extending side walls 516, which terminate in a generally outwardly extending peripheral skirt 520. The side walls 516 may not be exactly parallel to the spacing walls 508, and will typically have a slight angle corresponding to the shape of the closure portion 14 of the container 10.

The upper support surfaces 512 have defined therein a plurality of downwardly extending upper engagement fingers 524. In the embodiment shown, two spaced-apart upper engagement fingers 524 are disposed on each upper support surface 512, and one upper engagement finger 524 is positioned at each rounded corner junction 526 joining adjacent upper support surfaces 512. When the lid 500 is secured to the terminal rim 60 of the exemplary container 10, the upper engagement fingers 524 will engage the upper surface 120 of the terminal rim 60 so that the lid 500 is supported thereon.

The side walls 516 each have a plurality of inwardly extending side wall engagement fingers 530. In the illustrated embodiment, each side wall 516 has three inwardly extending side wall engagement fingers 530, with one side wall engagement finger 530 positioned approximately at the midpoint of the respective side wall 516, and one side wall engagement finger 530 positioned at each end of the respective side wall 516, adjacent the rounded corner junction 534 joining that side wall 516 to the adjacent side wall 516.

As can be seen, the upper engagement fingers 524 are in an offset, opposed relationship with the side wall engagement fingers 530. Thus, each upper engagement finger 524 is vertically spaced above, and horizontally positioned between, two side wall engagement fingers 530, and, correspondingly, each side wall engagement finger 530 is vertically spaced below, and horizontally positioned between, two upper engagement fingers 524.

The vertical spacing between the upper engagement fingers 524 and the side wall engagement fingers 530 corresponds to the vertical height of the terminal rim 60. This enables the lid 500 to be removably secured to the exemplary produce container 10 by pushing the lid 500 generally downward onto the closure portion 14 of the exemplary produce container 10 so that the terminal rim 60 is received in an interference fit between the upper engagement fingers 524 and the side wall engagement fingers 530.

Figure 7A:
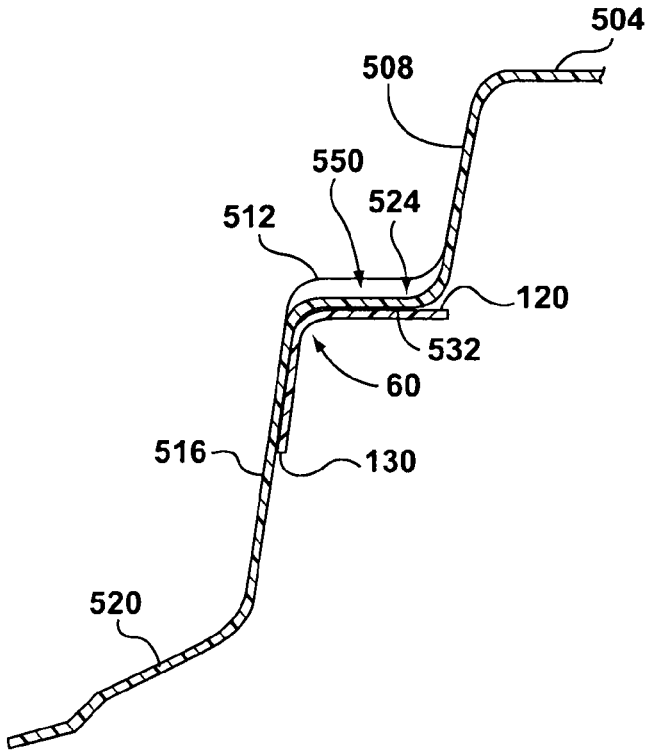
FIG. 7A is a cross-sectional view taken along the line 7A-7A in FIG. 6.
Figure 7B:
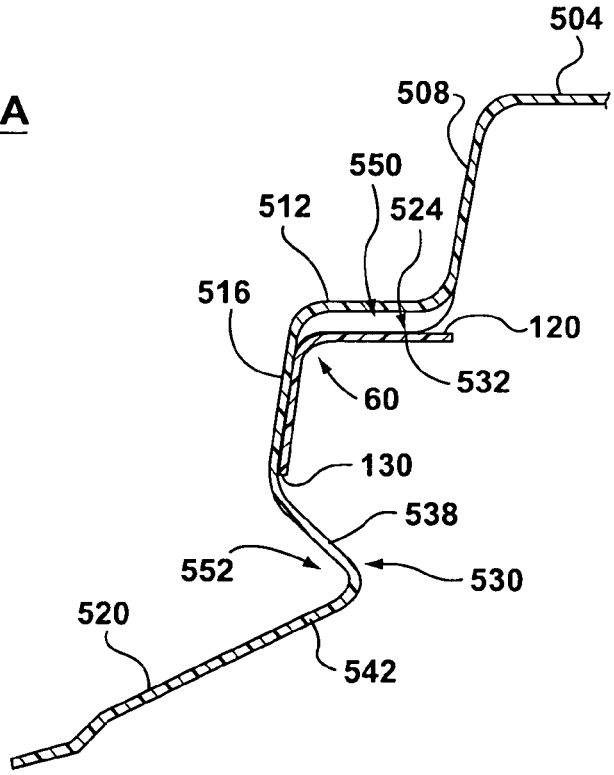
FIG. 7B is a cross-sectional view taken along the line 7B-7B in FIG. 6.

FIG. 7A shows exemplary engagement of the lower surface 532 of an upper engagement finger 524 with the upper surface 120 of the terminal rim 60, and FIG. 7B shows exemplary engagement of the sloping upper surface 538 of a side wall engagement finger 530 with the lower edge 130 of the terminal rim 60. The generally triangular shape of the side wall engagement fingers 530, coupled with the flexible resilience of the material from which the lid 500 is constructed, facilitates securement of the lid 500 to, and removal of the lid 500 from, the exemplary container 10. In particular, the upward slope of the lower surface 542 of the side wall engagement fingers 530 allows them to more easily slide past the upper surface 120 of the terminal rim 60 when the lid 500 is being secured, and the downward slope of the upper surface 538 of the side wall engagement fingers 530 allows them to more easily slide past the lower edge 130 of the terminal rim 60 when the lid 500 is being removed.

Continuing to refer to FIGS. 7A and 7B, in the illustrated embodiment, the upper engagement fingers 524 and the side wall engagement fingers 530 are formed by a shaping of the lid material, so that the downward projection of the upper engagement fingers 524 results in a corresponding depression 550 in the upper surface of the relevant upper support surface 512, and the inward projection of the side wall engagement fingers 530 results in a corresponding indentation 552 in the relevant side wall 516.

The covering portion 504 has a plurality of apertures 560 defined therein, adjacent the edges thereof, to further facilitate "breathing" by the produce. As can be seen in FIGS. 5 and 6, the apertures 560 may be positioned so as to leave a corner region 562 of the covering portion 504 free of apertures 560, so that a generally triangular adhesive label may be applied to the corner region 562 without risk of the adhesive underside coming in contact with produce by way the apertures 560.

Figure 8A:
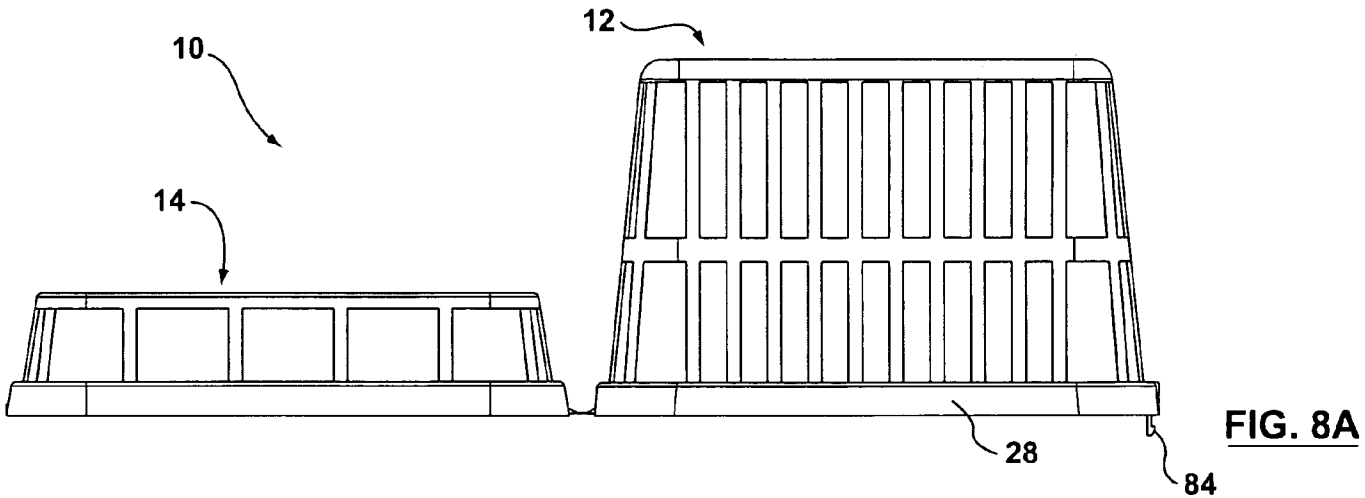
FIG. 8A is a side view of the exemplary produce container of FIG. 1.
Figure 8B:
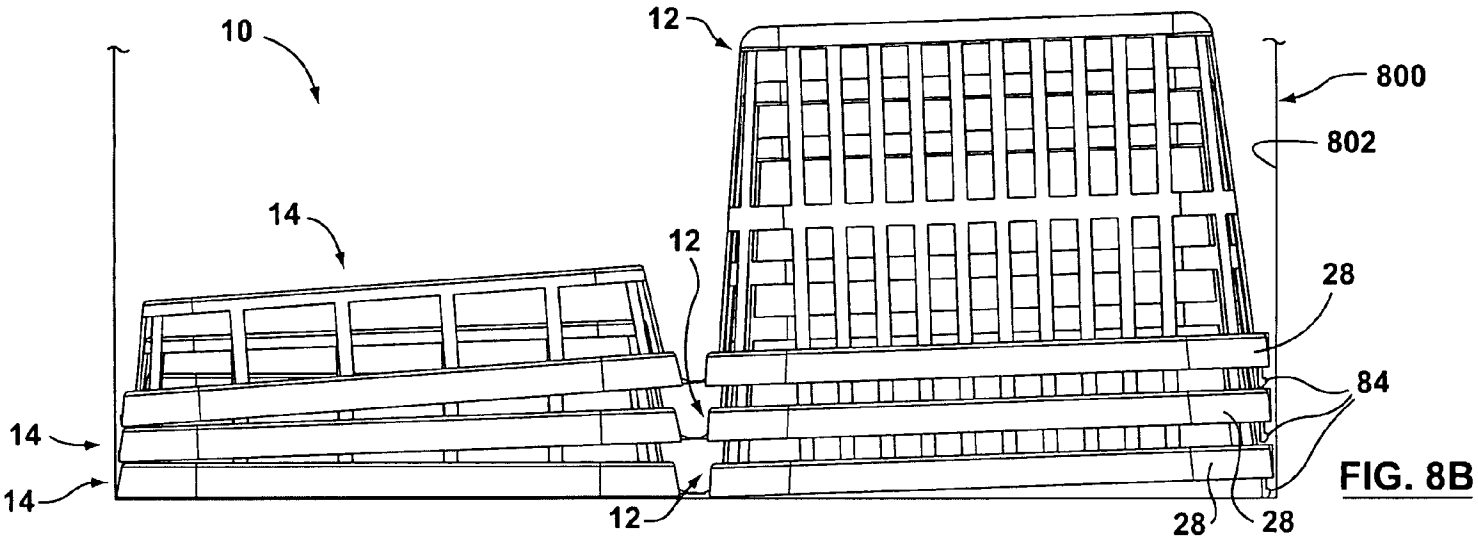
FIG. 8B is a side view of a plurality of exemplary produce containers such as the exemplary produce container of FIG. 1, nested together.

With reference now to FIGS. 8A and 8B, nesting of the exemplary containers for shipping, for example from a location of manufacture to a location where produce will be placed in the containers 10, is shown. As shown in FIG. 8A, a given container 10 is moved into the open configuration, with the basket portion peripheral lip 28 and the closure portion peripheral lip 68 being substantially parallel. Once so configured, several containers 10 can be stacked in a nested arrangement within a shipping container 800, as shown in FIG. 8B. More particularly, each closure portion 14 will nest inside the closure portion above it, and each basket portion 12 will nest inside the basket portion above it.

Containers according to aspects of the present invention, such as exemplary container 10, provide advantages in shipping.

Because the receiving slots 90 are defined inwardly of the outer surface 92 of the front edge of the closure portion peripheral lip 68, the outer surface 92 of the front edge of the closure portion peripheral lip 68 does not include any protrusions that would interfere with the fit of the container 10 within a shipping box (i.e. the outer surface 92 of the front edge of the closure portion peripheral lip 68 will be flush with the inside surface 802 of the shipping container. For the same reason, as noted above each locking projection 86 terminates inwardly of (i.e. does not extend beyond) the outer surface 108 of the front edge of the basket portion peripheral lip 28.

Moreover, the use of the recesses 94 defined in the outer surface 92 of the front edge of the closure portion peripheral lip 68, and in particular the recess engagement surface 96, allows the tabs 84 to be shortened, relative to a container in which the slots extend all the way through the closure portion peripheral lip 68, in which case the upper surface of the closure portion peripheral lip would define the engagement surface for the locking projection 86. This shortening of the tabs 84 is reflected in the fact that, as noted above, each tab 84, including the locking projection thereof, terminates below (i.e. does not extend beyond) the upper surface 106 of the closure portion peripheral lip 68. When containers such as containers 10 are nested as shown in FIG. 8B, the tabs 84 on a given container 10 will abut the underside of the basket portion peripheral rim 28 on the container below, so that the shorter the tabs 84, the greater the number of containers 10 that can be packed in a given shipping box 800.

Moreover, in the illustrated embodiment each tab 84 projects upwardly from a position spaced inwardly from the outer surface 108 of the front edge of the basket portion peripheral lip 28, and each locking projection 86 terminates inwardly of (i.e. does not extend beyond) the outer surface 108 of the basket portion peripheral lip 28.

Figure 9B:
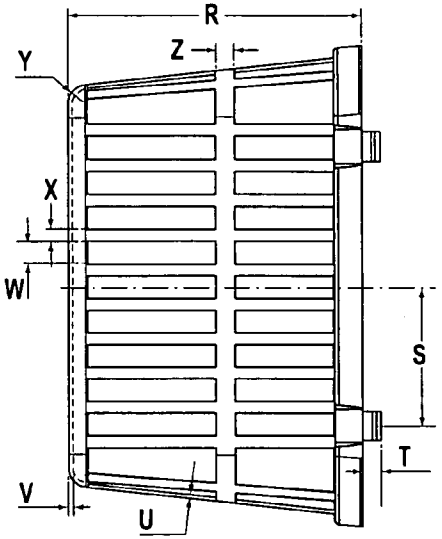
FIG. 9B is a front view of the produce container of FIG. 9A, showing dimension markings.
Figure 9A:
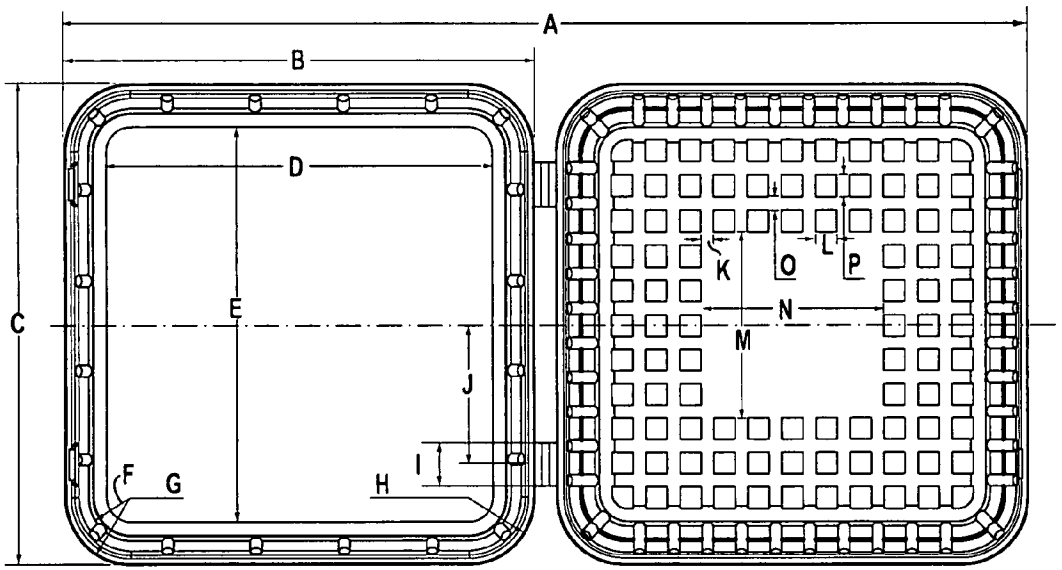
FIG. 9A is a top view of a presently preferred embodiment of a produce container according to an aspect of the present invention, showing dimension markings.
Figure 9C:
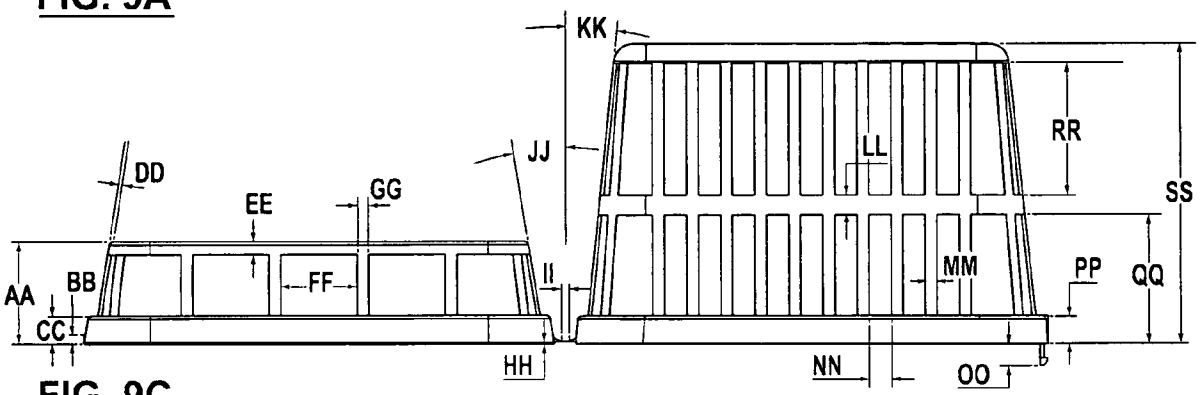
FIG. 9C is a side view of the produce container of FIG. 9A, showing dimension markings.

Reference is now made to FIGS. 9A, 9B and 9C, which are dimension drawings for an embodiment of a produce container according to aspects of the present invention. In FIGS. 9A, 9B and 9C, reference letters A, B, C, . . . QQ, RR, SS have been used to denote various dimensions. The chart below sets out the corresponding numerical dimensions of a currently preferred embodiment of a produce container according to aspects of the present invention.

| Reference | Dimension |
|---|---|
| A | 248.0 millimeters |
| B | 121.3 millimeters |
| C | 121.3 millimeters |
| D | 99.6 millimeters |
| E | 99.6 millimeters |
| F | 6.17 millimeters (radius) |
| G | 17.06 millimeters (radius) |
| H | 17.06 millimeters (radius) |
| I | 11.0 millimeters |
| J | 35.3 millimeters |
| K | 3.3 millimeters |
| L | 5.5 millimeters |
| M | 47.1 millimeters |
| N | 47.1 millimeters |
| O | 3.3 millimeters |
| P | 5.5 millimeters |
| R | 75.3 millimeters |
| S | 35.35 millimeters |
| T | 5.0 millimeters |
| U | 0.9 millimeters |
| V | 1.1 millimeters |
| W | 5.8 millimeters |
| X | 3.0 millimeters |
| Y | 5.0 millimeters (radius) |
| Z | 5.0 millimeters |
| AA | 25.9 millimeters |
| BB | 2.5 millimeters |
| CC | 7 millimeters |
| DD | 0.9 millimeters |
| EE | 3.3 millimeters |
| FF | 19.7 millimeters |
| GG | 3.0 millimeters |
| HH | 0.3 millimeters |
| II | 2.0 millimeters |
| JJ | 9 degrees |
| KK | 6 degrees |
| LL | 5.0 millimeters |
| MM | 3.0 millimeters |
| NN | 5.8 millimeters |
| OO | 5.0 millimeters |
| PP | 7.0 millimeters |
| QQ | 32.5 millimeters |
| RR | 32.9 millimeters |
| SS | 75.3 millimeters |

Figure 10A:
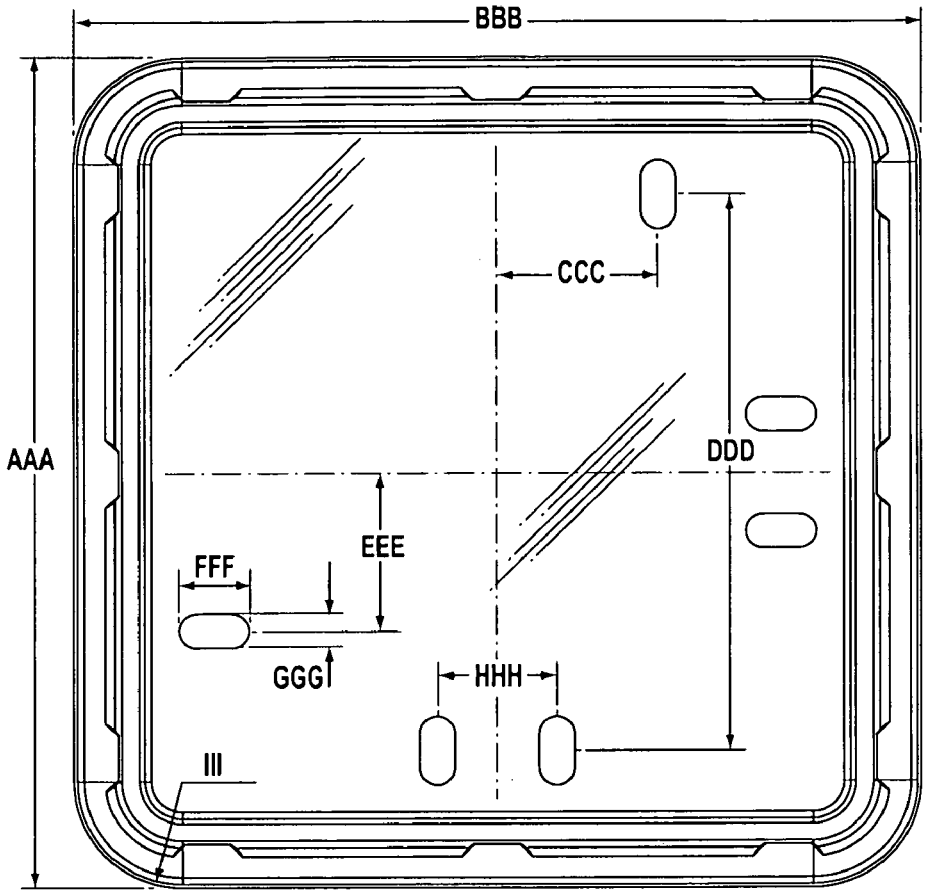
FIG. 10A is a top view of a presently preferred embodiment of a lid for a produce container such as the produce container of FIG. 9A, showing dimension markings.
Figure 10B:
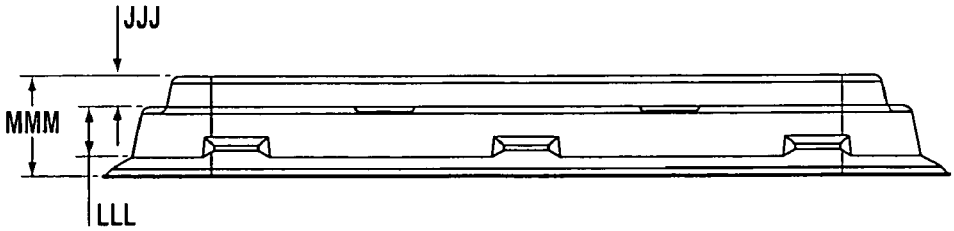
FIG. 10B is a front view of the lid of FIG. 10A, showing dimension markings.

Reference is now made to FIGS. 10A and 10B, which are dimension drawings for an embodiment of a lid according to aspects of the present invention. In FIGS. 10A and 10B, reference letters AAA, BBB, CCC, . . . MMM have been used to denote various dimensions. The chart below sets out the corresponding numerical dimensions of a currently preferred embodiment of a lid according to aspects of the present invention, such an embodiment being suitable for use with a produce container having the dimensions described above in the context of FIGS. 9A, 9B and 9C.

| Reference | Dimension |
|---|---|
| AAA | 121.0 millimeters |
| BBB | 121.0 millimeters |
| CCC | 23.05 millimeters |
| DDD | 81.0 millimeters |
| EEE | 23.05 millimeters |
| FFF | 10.0 millimeters |
| GGG | 5.0 millimeters |
| HHH | 17.0 millimeters |
| III | 15.50 millimeters (radius) |
| JJJ | 4.50 millimeters |
| LLL | 7.41 millimeters |
| MMM | 14.50 millimeters |

One or more currently preferred embodiments have been described by way of example. It will be apparent to persons skilled in the art that a number of variations and modifications can be made without departing from the scope of the invention as defined in the claims.

What is claimed is:

1. A produce container, comprising:

a basket portion, the basket portion comprising a base and four basket portion walls extending between the base and a basket portion peripheral lip, each basket portion wall being secured to each adjacent basket portion wall;

a closure portion, the closure portion comprising a terminal rim and four closure portion walls extending between the terminal rim and a closure portion peripheral lip, each closure portion wall being secured to each adjacent closure portion wall;

wherein the basket portion peripheral lip and the closure portion peripheral lip are hingedly secured to one another at respective rear edges thereof so that the basket portion and the closure portion are relatively movable between an open configuration and a closed configuration in which the basket portion peripheral lip and the closure portion peripheral lip are in registration with one another;

and wherein:

the basket portion peripheral lip has at least one tab projecting upwardly from a front edge thereof, each at least one tab including an outwardly extending locking projection;

a front edge of the closure portion peripheral lip includes at least one receiving slot defined inwardly of an outer surface of the front edge of the closure portion peripheral lip for receiving a corresponding tab, each receiving slot extending into a collocated recess defined in the outer surface of the front edge of the closure portion peripheral lip and having a recess engagement surface;

so that, when the basket portion and the closure portion are in the closed configuration, the at least one tab is received within the at least one corresponding receiving slot so that each respective locking projection extends into the respective recess and an engagement surface on the respective locking projection cooperates with the respective recess engagement surface to secure the container in the closed configuration, each respective locking projection terminating inwardly of the outer surface of the front edge of the closure portion peripheral lip and each tab terminating below an upper surface of the closure portion peripheral lip;

further comprising a lid removably secured to the terminal rim;

wherein the lid comprises:

a substantially square, substantially planar covering portion having four edges;

four spacing walls depending downwardly from the edges of the covering portion;

each spacing wall continuing into an outwardly extending upper support surface which is substantially parallel to the covering portion so that there are four upper support surfaces, the four upper support surfaces being, collectively, co-extensive with an upper surface of the terminal rim of the produce container, each upper support surface having defined therein a plurality of downwardly extending upper engagement fingers;

each upper support surface continuing into a substantially downwardly extending side wall so that there are four such side walls, the side walls terminating in a generally outwardly extending peripheral skirt, each side wall having a plurality of inwardly extending side wall engagement fingers;

wherein:

the upper engagement fingers are vertically spaced from the side wall engagement fingers by a distance corresponding to the vertical height of the terminal rim, and the lid is removably secured to the container by an interference fit of the terminal rim between the upper engagement fingers and the side wall engagement fingers.

2. The produce container of claim 1, wherein the upper engagement fingers and the side wall engagement fingers are in an offset, opposed relationship so that each upper engagement finger is vertically spaced above, and horizontally positioned between, two side wall engagement fingers, and each side wall engagement finger is vertically spaced below, and horizontally positioned between, two upper engagement fingers.

3. The produce container of claim 2, wherein two spaced-apart upper engagement fingers are disposed on each upper support surface, and one upper engagement finger is positioned at each corner junction joining adjacent upper support surfaces, and wherein each side wall has three inwardly extending side wall engagement fingers, one side wall engagement finger being positioned approximately at a midpoint of the respective side wall, and one side wall engagement finger being positioned at each end of the respective side wall.

4. The produce container of claim 2, wherein each of the side wall engagement fingers has a generally triangular shape, including a downwardly sloping upper surface and an upwardly sloping lower surface.

5. The produce container of claim 1, wherein the covering portion has a plurality of apertures defined therein adjacent the edges of the covering portion, the apertures being positioned so as to define a corner region of the covering portion that is free of apertures, further comprising a generally triangular adhesive label applied to the corner region.

* * * * *